US007035378B2

(12) United States Patent
Martinez et al.

(10) Patent No.: US 7,035,378 B2
(45) Date of Patent: Apr. 25, 2006

(54) X-RAY TUBE WITH GRAPHITE WINDOW

(75) Inventors: Lilian Martinez, Lyons (FR); Daniel Veillet, Allinges (FR)

(73) Assignee: THALES, Neuilly-sur-Seine ( * ) Notice: Subject to any disclaimer, the term of this patent is extended or adjusted under 35 U.S.C. 154(b) by 74 days.

(21) Appl. No.: 10/476,576

(22) PCT Filed: Apr. 26, 2002

(86) PCT No.: PCT/FR02/01470

§ 371 (c)(1),
(2), (4) Date: Oct. 31, 2003

(87) PCT Pub. No.: WO02/091420

PCT Pub. Date: Nov. 14, 2002

(65) Prior Publication Data

US 2004/0125919 A1 Jul. 1, 2004

(30) Foreign Application Priority Data

May 4, 2001 (FR) ..... 01 06023

(51) Int. Cl.
*H01J 35/18* (2006.01)

(52) U.S. Cl. ..... 378/140; 378/161

(58) Field of Classification Search ..... 378/161, 378/119–144

See application file for complete search history.

(56) References Cited

U.S. PATENT DOCUMENTS

| | | | | |
|---|---|---|---|---|
| 1,933,005 | A * | 10/1933 | Bouwers | 378/125 |
| 3,916,200 | A | 10/1975 | Sparks, Jr. et al. | 250/389 |
| 4,213,055 | A * | 7/1980 | Schrijvers et al. | 250/214 VT |
| 5,659,223 | A | 8/1997 | Goodman | 315/39 |
| 6,567,500 | B1 * | 5/2003 | Rother | 378/140 |

FOREIGN PATENT DOCUMENTS

| | | |
|---|---|---|
| EP | 0 723 281 A | 7/1996 |
| EP | 0 925 742 A | 6/1999 |
| FR | 1 378 909 A | 3/1965 |

* cited by examiner

*Primary Examiner*—Craig E. Church
*Assistant Examiner*—Jurie Yun
(74) *Attorney, Agent, or Firm*—Lowe Hauptman & Berner, LLP

(57) ABSTRACT

The invention relates to X-ray vacuum tubes. To let the X-rays out of the tube, in the case of an X-ray generator tube, when the wall of the tube is made of metal, the invention provides an exit window (50) that is made of pyrolytic graphite. The window preferably has a bell shape and is brazed to a copper collar (60) that is itself brazed to the metal wall (10) of the tube.

4 Claims, 2 Drawing Sheets

X-RAY TUBE WITH GRAPHITE WINDOW

The invention relates to X-ray tubes and especially to X-ray generator vacuum tubes. It will be described with regard to such generator tubes, although it can also be applied to X-ray detector vacuum tubes (of the radiological image intensifier RII type).

Vacuum tubes serving as an X-ray source are used for example in the nondestructive testing of physical objects (metal structures, composites, luggage, etc.). They are also used in medical imaging.

An X-ray generator vacuum tube essentially comprises a cathode that emits a high-energy electron beam and a metal target placed in the path of the electron beam. The target thus bombarded with the electrons emits X-rays within a preferential angular sector depending on the angle of incidence of the electrons on the surface of the target. Typically, the surface of the target at the point of impact of the beam lies in a plane inclined at about 70° to the direction of the incident beam and it then sends back X-rays in a cone with an angle of a few tens of degrees centered approximately on a normal to the beam.

The X-rays must be able to leave the tube. If the walls of the tube are made of metal, which is usually the case, an exit window, made of a material as least X-ray absorbent as possible, is preferably provided opposite the angular X-ray emission sector. The rest of the wall is made of metal and also protects the environment from the emission of X-rays in undesirable directions, i.e. out of the preferential angular emission sector. The exit window contributes, like the rest of the wall of the tube, to sealing against the vacuum that exists inside the tube.

The difficulty lies in the production of this window, given that it is necessary to use a material having both good transparency to X-rays and also mechanical, chemical and thermal properties that make it suitable for maintaining vacuum-tightness and simple industrial production of the tube.

One of the materials most widely used is beryllium. It has good transparency to X-rays for thicknesses ranging up to one millimeter and more; it has mechanical strength properties sufficient to produce windows approximately 20 millimeters in diameter (with a thickness of one millimeter), which is sufficient for a number of applications.

However, this material has several drawbacks. Firstly, it is toxic, which imposes major industrial constraints and problems of reprocessing spent tubes; secondly, it is very expensive; and finally it cannot be joined directly to copper. Now, the walls and the other elements of the support for the tube to which it is desired to join the window are usually made of copper. Direct brazing of beryllium to copper would result in intermetalic diffusion in these two materials. This diffusion weakens the assembly and reduces the vacuum-tightness. It is therefore necessary to use more complex assemblies, with intermediate materials such as nickel to ensure sealing without direct contact between copper and beryllium.

To avoid the drawbacks of the prior art, the invention proposes an X-ray vacuum tube that includes a wall provided with a window through which the X-rays pass, characterized in that this window is made of pyrolytic graphite and is bell-shaped, i.e. it has a domed surface.

The term "pyrolytic graphite" is understood to mean carbon with a graphite crystal structure (that differs especially from the crystal structure of diamond), deposited by progressive growth on an intermediate substrate from the chemical decomposition of hydrocarbons at very high temperature, and then separated from this intermediate substrate by a demolding operation. The intermediate substrate is there only to determine the final shape of the graphite part.

This type of material may be shaped as required (preferably, however, with circular symmetry). It exhibits good mechanical resistance to forces directed perpendicular to its surface. It exhibits lower mechanical resistance to tensile forces directed parallel to the surface, but the window is preferably given a shape such as to minimize the forces parallel to the surface. In particular, rather than giving it a flat disk shape, as would be the case with beryllium, it will be given a bell (or crucible) shape.

The bell will preferably be brazed to a copper collar, the collar then being brazed to the copper wall of the tube. There is no significant incompatibility between graphite and copper and this type of assembly ensures lasting vacuum-tightness. The graphite/copper braze preferably used is an active braze composed of silver, copper and titanium.

The thickness of the graphite window is preferably between 0.5 and 1.5 millimeters in order for the X-ray absorption by the window to be sufficiently limited, the absorption coefficient of graphite being greater than that of beryllium.

Other features and advantages of the invention will become apparent on reading the detailed description that follows, given with reference to the appended drawings in which.

Figure 1:
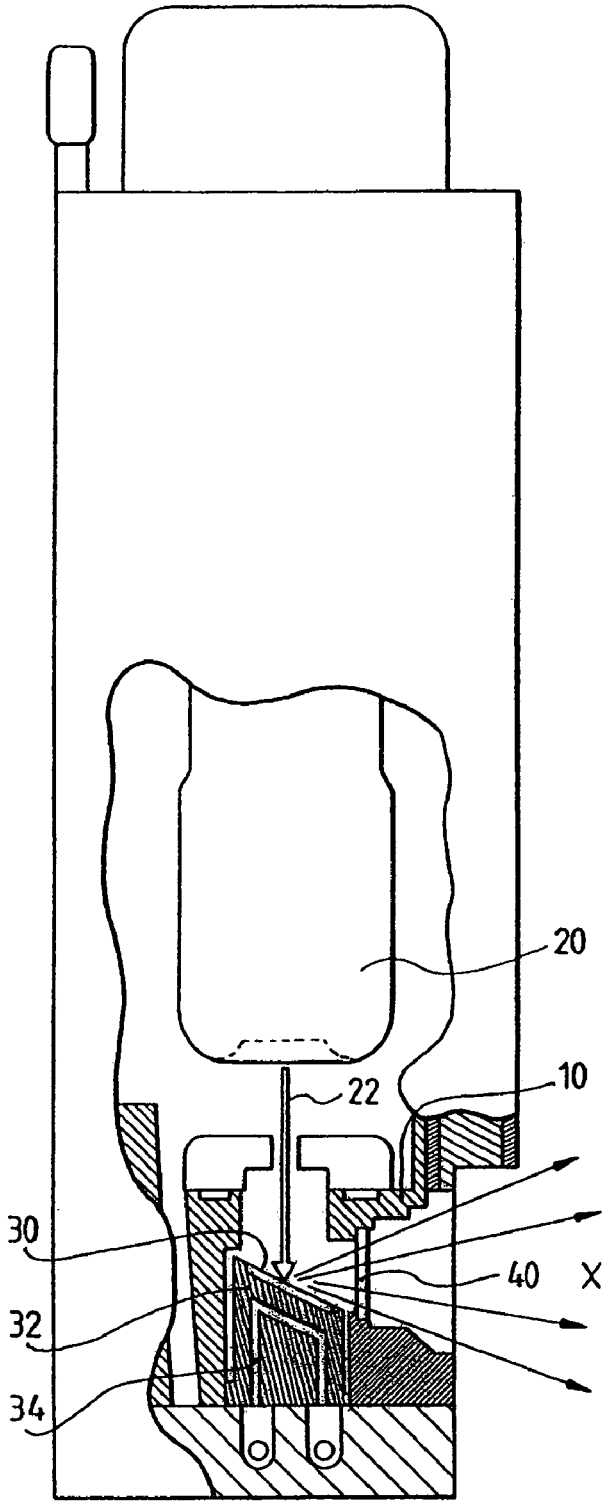
FIG.1 PRIOR ART
FIG. 1 shows an X-ray generator tube of the prior art, with a beryllium exit window.

Shown schematically in FIG. 1 is a generally cylindrical X-ray generator vacuum tube having a wall 10, in principle made of copper, and inside the wall, essentially an electron gun 20 and a metal target 30. The tube is shown with its wall partly open in order to reveal these elements. The electron gun emits an electron beam 22 along the axis of the tube. The beam is focused onto its axis, on the one hand, by virtue of the shape of the cathode of the gun and of the electrodes that surround it (especially a wehnelt used to focus the beam) and, on the other hand, optionally by other electrodes distributed along the length of the tube.

The high-energy electron beam is directed onto the metal target 30. This target is preferably made of tungsten. Its surface is plane. In this example, the target is fixed, but it would be conceivable for it to rotate, in order to rotate the point of impact and therefore to limit the heat-up of the target. The target may be formed by a tungsten plate embedded in a copper block 32 promoting dissipation of the heat generated by the impact of the electrons on the target. Cooling by circulating water is preferably provided in channels 34 formed in the copper block.

At the point of impact of the electron beam on the target, the surface of the target makes an angle of about 70° to the axis of the electron beam. The impact of the beam causes the emission of X-ray photons from the target. Most of the photons are emitted in a cone with a cone angle of about 45°, starting from the point of impact of the electrons. The axis of this cone is approximately perpendicular to the axis of the electron beam and lies in a plane containing both the axis of the beam and the normal to the plane of the target.

A window 40 through which the X-rays pass is provided in the wall of the tube, opposite this X-ray emission cone.

The window is generally circular; its size may be about 20 millimeters in diameter and it is then placed at about 30 millimeters from the point of impact of the beam if it is desired to let the emitted X-rays pass through over the entire cone of about 45°.

In the prior art, the window 40 is a flat beryllium disk mounted on one or two nickel collars (not shown) so that the beryllium is not joined directly to the copper but forms the internal walls of the tube and serves as support for the window. The window is brazed around the perimeter of an aperture formed in the wall of the tube and provides a vacuum seal at the point where the X-rays exit.

Figure 2:
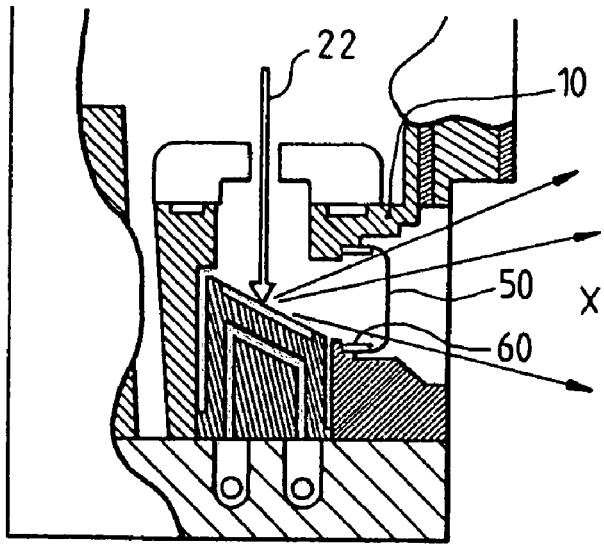
FIG. 2 shows a partial view of a tube according to the invention, with a window made of pyrolytic graphite.

According to the invention, as shown in FIG. 2, which shows that part of the tube carrying the exit window, the beryllium window 40 is replaced with a window 50 made of pyrolytic graphite. This window 50 has the shape of a bell and is preferably mounted on a copper cylindrical collar 60 which is sealed or brazed onto the periphery of the aperture of the wall of the tube. The term "bell shape" is understood to mean a surface whose edges do not lie in the plane of the central part: the surface has a central part that is approximately perpendicular to the central axis for emission of the X-rays, while the edges of the surface tend to lie close, at least in part, to the direction of this axis.

Pyrolytic graphite has a carbon crystal structure with a hexagonal lattice (unlike diamond carbon, which is cubic) obtained by decomposition of hydrocarbons (in practice, a mixture of methane and hydrogen) in a furnace at very high temperature, and obtained by progressive growth, atomic layer by atomic layer on a mandrel serving as intermediate substrate for the deposition.

The temperature of deposition is preferably about 2270 K. The support mandrel must withstand this temperature. It may be made of graphite (nonpyrolytic graphite) obtained by heat treatment of a carbon block. It has the bell shape of the window to be produced. When the thickness of the desired part is obtained (about 0.5 to 1.5 millimeters), the growth is stopped and the part is demolded. Simply because of the difference in expansion coefficients between the mandrel (nonpyrolytic graphite) and the part produced (pyrolytic graphite), the part is easy to demold. A layer of soot may furthermore be deposited on the mandrel before deposition of the pyrolytic graphite, in order to facilitate demolding.

The demolded graphite window, with a bell shape, may have a diameter of about 20 millimeters and a height of 10 to 15 millimeters. The bell shape gives the part elasticity in all directions. This is because the structure of pyrolytic graphite is such that it has a low resistance to tensile forces parallel to the plane of deposition of the layers, but has a high resistance to bending forces perpendicular to this plane. A pyrolytic graphite disk replacing purely and simply the beryllium disk of the prior art would be less strong than the bell-shaped window.

The window ensures that the tube remains vacuum-tight.

Figure 3:
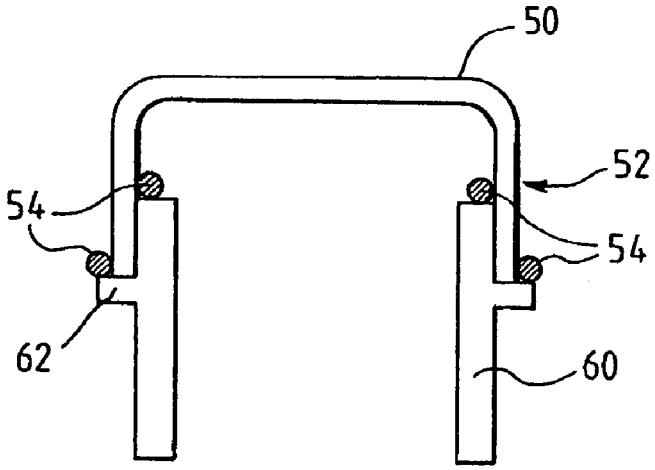
FIG. 3 shows an enlarged view of the window itself, mounted on a copper support before being brazed to the tube.

FIG. 3 shows in detail the window 50, mounted on a copper collar 60 for the purpose of being brazed to this collar. The inside diameter of the skirt 52 of the bell-shaped window is equal to the outside diameter of the copper collar. The skirt is slipped onto the collar and is brazed at the collar surface in contact with the skirt. The braze, shown by a peripheral bead 54, is preferably an active braze composed of silver, copper and titanium (ABA cusil braze bead).

The collar preferably has a rim 62 on which the base of the skirt 52 bears.

The collar thus bonded to the graphite window is itself brazed to the wall of the X-ray generator tube. Here the braze is a copper-to-copper braze that poses no problem and provides a good vacuum seal.

The X-ray absorbency of graphite is approximately twice that of beryllium, but the strength of graphite (especially with the bell shape of the window) allows a graphite thickness to be chosen that is approximately twice as small as the thickness of beryllium that would be necessary for a window of the same diameter.

Unlike beryllium, graphite incurs no industrial constraint and, in particular, no problem of toxicity.

It will be understood that the invention is also applicable to tubes that can be used for X-ray detection, in order to let X-rays coming from the outside, whose intensity or intensity distribution it is desired to measure for example, pass through the window into the detector tube.

The invention claimed is:

1. An X-ray generator vacuum tube, comprising:

a wall provided with an exit window through which X-rays pass, wherein the window is a bell-shaped window made of pyrolytic graphite, wherein the window is brazed to a copper collar, the collar then being brazed to an aperture in the copper wall of the tube.

2. The tube as claimed in claim 1, wherein the window is brazed to the collar using an active braze composed of silver, copper and titanium.

3. The tube according to claim 2, wherein the thickness of the graphite window is about 0.5 to 1.5 millimeters.

4. The tube according to claim 1, wherein the thickness of the graphite window is about 0.5 to 1.5 millimeters.

* * * * *